United States Patent [19]

Wyler et al.

[11] Patent Number: 4,838,892

[45] Date of Patent: Jun. 13, 1989

[54] THERMOPLASTIC LEATHER MATERIAL AND ITS PREPARATION

[76] Inventors: Adolf Wyler, 25 Bayit Vegan Street, Jerusalem, 96425; Herbert J. Wagner, 3 Anderson St., Tel-Aviv, both of Israel, 69107

[21] Appl. No.: 81,656

[22] Filed: Aug. 4, 1987

Related U.S. Application Data

[63] Continuation of Ser. No. 827,255, Feb. 7, 1986, abandoned.

[30] Foreign Application Priority Data

Mar. 1, 1985 [IL] Israel ..... 74480

[51] Int. Cl.[4] ..... C14C 13/00

[52] U.S. Cl. ..... 8/94.1 R; 8/94.15

[58] Field of Search ..... 8/94.1 R, 94.15

[56] References Cited

U.S. PATENT DOCUMENTS 1,556,623 10/1925 Minor ..... 8/94.21

3,505,169 4/1970 Parker ..... 8/94.21

*Primary Examiner*—Paul Lieberman

*Assistant Examiner*—John F. McNally

*Attorney, Agent, or Firm*—Steinberg & Raskin

[57] ABSTRACT

A novel thermoplastic composition of matter is produced by subjecting leather, especially particulate leather scrap optionally admixed with one or more additives and/or fillers, to the action of a pressure from about 200 to 900 bar, at a temperature from about 50° to about 250° C. in a closed die for a time of at least about 30 seconds.

3 Claims, No Drawings

THERMOPLASTIC LEATHER MATERIAL AND ITS PREPARATION

This is a continuation, of application Ser. No. 827,255, filed 2/7/86 now abandoned.

BACKGROUND OF THE INVENTION

The present invention provides a novel thermoplastic composition of matter obtained by plasticizing scraps of leather (as herein defined) under the action of elevated pressure and temperature. The invention further provides a process for the production of said novel composition of matter.

The term "leather" as used herein is meant to refer to both tanned and untanned natural leather, skins or hides of all kinds of animal origin.

One of the objects of the present invention is to make use of leather scraps, comparatively large amounts of which are the necessary by-products of the leather products industry, especially the shoe industry. Such leather scrap is available in various forms, e.g. flat pieces of various shapes, narrow strips, grains and powder. Despite the comparatively high price of natural leather, hardly any significant attempts have hitherto been made to exploit these leather scraps, even less to convert it to industrially useful materials.

It has now been surprisingly found in accordance with the present invention that when leather scrap is subjected to the action of high pressure and moderately elevated temperatures in a closed die for comparatively short periods, there is obtained a novel and useful composition of matter having advantageous physical properties which render it useful in various technical and industrial applications.

The invention thus provides, in one aspect thereof, a novel thermoplastic composition of matter consisting substantially of leather (as herein defined) which has been converted to a solid thermoplastic mass by the action of a pressure from about 200 to about 900 bar at a temperature from about 50° to about 250° C. in a closed die, said composition of matter optionally including additives and/or fillers.

In another aspect, the invention provides a process for producing the above-described novel composition of matter, which comprises subjecting leather (as herein defined), optionally admixed with one or more additives and/or fillers, to the action of a pressure from about 200 to about 900 bar, at a temperature from about 50° to about 250° C. in a closed die for a time of at least about 30 seconds.

DESCRIPTION OF PREFERRED EMBODIMENTS

The scrap leather suitable for use as a starting material in the process of the invention, is preferably particulate and may be in the form of powder, grains, fibres or the like. These are either obtained as such from the leather article industry or may be obtained by comminution of larger pieces. It has been found that the size of the leather scrap particles is not critical and may range from a fine powder to comparatively coarse grains, shreds or fibres and even larger pieces can be used.

Suitably the process of the invention is carried out in a conventional die provided with heating means. In this manner the resultant material may be directly molded to the shape of the final article desired above. Alternatively the process may be carried out by first preparing a so-called "green compact", i.e. a partially compressed material, in some convenient form, such as pellets or briquets. This semi-finished material can be stored and, if desired, shipped to another site, thereafter being compression-molded into a desired final shape in a second die.

It was observed, in accordance with the present invention, that after the scrap leather starting material had been compressed at room temperature under the action of elevated pressures (of above about 700 bar) and thereafter gradually heated in the die, at constant volume, under the same or a somewhat lower initial pressure, the internal pressure of the material in the die first decreased steadily until it reached a plateau. It is assumed that over this pressure plateau a gradual plasticization of the material takes place until a maximum plasticization is reached at a certain characteristic temperature $T_c$ at which the plateau ends and, upon continued rise of temperature, the internal pressure increases as a substantially linear function of the temperature. This temperature $T_c$ can be determined experimentally for each type of starting material and was found to be dependent on the pressure and length of time of the initial compression of the starting material at room temperature, on the initial pressure applied when the heating was started and on the heating rate. When the material is cooled as soon as it reaches said characteristic temperature $T_c$ the product is found to be a brown plasticized material. The properties of the product can be modified at will by changing the length of time the initial product is heated under pressure at said temperature $T_c$ or a somewhat higher temperature. The longer this heating, the more plasticized and darker brown is the product. The product was found to be thermoplastic upon reheating.

The new composition of matter according to the invention is basically a solid, rigid and comparatively hard material ranging in colour from light grey to brownish and resembling a synthetic resin in general appearance. The new material is fully thermoplastic and was found to soften at a temperature of about 35°–50° C. at elevated pressure as shown in Example 4. In its rigid state, the new composition of matter is machinable. The new material possesses good resistance to UV light; thus, three days exposure to the sun resulted in no perceptible change of the material. On hardness tests, the new composition of matter was found to withstand a pressure of 500 kg/cm$^2$.

The above-described physical properties of the new composition of matter according to the invention, can be modified by the admixture of suitable additives and/or fillers. Thus, the strength of the material may be increased by the incorporation of high strength fibres (e.g. glass, graphite, metal) or particulates or flakes, as reinforcement. The new composition of matter may be rendered thermally and electrically conductive by the incorporation of powdered carbon or metal wire staple, in particular copper. Other possible additives which may be suitably included in the new composition of matter are, e.g. pigments, stabilizers, antioxidants, plasticizers and/or hydrophobic agents.

The invention and manner of carrying it out are illustrated in the following non-limiting examples:

EXAMPLE 1

Finely shredded tanned cow leather was packed into the cylindrical cavity (diameter—25 mm; depth—75 mm) of a die made of H13 die steel, provided with means for electrical heating and water cooling, after preliminary lubrication of the die cavity with a silicone mold-release agent. Pressure was then applied to the starting material in the die cavity through the piston. When the pressure in the die cavity reached about 700 bar, the heater was turned on and the temperature allowed to rise to 140° C. while maintaining the same force (about 3 tons) on the main piston. At a temperature of about 100° C., the material softened, became plastic and was densified, as shown by a gradual downward movement of the piston, until full compression of the material was attained. The same pressure and temperature were maintained for a further 8 minutes, whereafter the heater was turned off and the die cooled by circulation of cooling water. During the cooling period the pressure was maintained at its previous level until the temperature had fallen to about 40° C. After further cooling to about 30° C., the die was opened and the formed cylindrical piece was extracted therefrom. The material was found to be hard and smooth, its surface-finish corresponding to that of the die. The material was brown and had a density of 1.1–1.2 g/cm$^3$ (as compared to the density of leater 0.86–1.02 g/cm$^3$)and a hardness of $H_D=85$ in the Shore D test (ASTM).

EXAMPLE 2

Preparation of a shaped object by a two-step process

In a first step the same starting material as in Example 1 was used and the same procedure followed, except that the fully compressed plasticized material was held at the high temperature for one minute only and the die was immediately cooled to room temperature. There was obtained a, so-called, "green compact" which was not yet fully densified, was still greyish-white in colour and not glossy, but was rigid enough for handling.

In a second step the above-obtained green compact was placed into the cavity of another die having a different shape than the cylindrical green compact. This second die was then heated gradually up to 140° C. and a pressure of 300 bar was applied to the compact through the piston. The temperature and pressure were maintained for about 3 to 5 minutes. It was observed that when the temperature had reached about 120° C. the material started to flow plastically and completely filled the die cavity. The die was then cooled under the same pressure until a temperature of about 30° C. was reached. The shaped product was then extracted from the die. It was smooth and glossy, brown in colour and had the same physical properties as the product obtained in Example 1.

EXAMPLE 3

Flakes of ground white pelt (average grain size about 4×1.5×0.75 mm) were placed in the cavity of a pressure cylinder wherein the material was compressed at room temperature under an initial pressure $P_o$ (generally 690 bar) for 20 minutes. The initial pressure $P_o$ was then maintained or reduced to a lower pressure $P_l$ (see Table 1 below) and the temperature was gradually raised at the rate of 5° C./min., at a constant volume of the die cavity (fixed position of the die piston). The change in pressure inside the die cavity was recorded against the temperature increase. It was observed that in a first stage the pressure fell steadily, reaching a plateau (the second stage) wherein the pressure remained constant up to a characteristic temperature $T_c$ at which the pressure started to rise as a substantially linear function of the temperature. The temperature $T_c$ was found to be dependent on the nature and physical form of the starting material, on the initial pressure $P_o$ and the length of time the material was submitted to that pressure at room temperature, on the pressure $P_l$ and, possibly, on the rate of heating. The results are shown in the following Table 1.

TABLE 1

| $P_o$ (bar) | $P_l$ (bar) | $T_c$ (°C.) |
|---|---|---|
| (for 20 min.) | | |
| 920 | 920 | 67 |
| 690 | 690 | 81 |
| 690 | 554 | 81 |
| 690 | 462 | 83 |
| 690 | 373 | 87 |
| 690 | 318 | 88 |
| 690 | 288 | 91.5 |
| 690 | 272 | 92 |
| 690 | 231 | 96.5 |
| 690 (for 2 hrs.) | 690 | 76 |
| 690 (for 6 hrs.) | 690 | 72 |

When the die was cooled and opened immediately after the temperature $T_c$ was reached (at a given heating rate and initial pressure $P_l$), it was found that a certain amount of brown, plasticized material was formed. The longer the material was kept under pressure at the temperature $T_c$, the product material became more and more plasticized and darker brown in colour. Desired properties of the product can thus be achieved by regulating the length of time during which the material is maintained under the pressure $P_l$, at the temperature $T_c$ or some higher temperature.

In one experiment the starting material was first compressed at $P_o=690$ bar and thereafter left in the die cavity at atmospheric pressure and a temperature of 145° C. for 10 minutes, then cooled quickly to room temperature. The product was found to be a hard brown material having a spongy structure.

Influence of grain size of starting material

The same white pelt starting material was ground to a finer grain size resembling coarse flour and processed as described above with $P_o=P_l=690$ bar. It was found that the temperature $T_c$ was 67° C. as compared to 81° C. in Table 1 above.

Influence of the nature of the starting material

Goat skin pelt ground to a fine flour was processed as above ($P_o=P_l=690$ bar) and exhibited a $T_c$ of 55° C., whereas a starting material of coarse brown flour from tanned shoe leather exhibited $T_c=100$° C.

EXAMPLE 4

Softening of fully processed material

Pelt flake material was processed in a cylindrical cavity of a die by heating to 150° C. for half an hour at a pressure of 690 bar. When the cylindrical shaped products thus obtained were reheated under pressures $P_l$ ranging from 230 to 925 bar, it was found that the $T_c$ had changed to 42°±5° C.

We claim:

1. Method for the production of a solid thermoplastic body from particulate leather scrap, said thermoplastic body having properties different from the leather from which it is formed, including thermoplasticity, which comprises subjecting said particulate leather scrap in a closed die to a pressure of about 200–900 bar, heating said particulate leather scrap in the closed die at said pressure at a temperature at about 50°-250° C. until said particulate leather scrap softens, becomes plastic and is densified, thus converting the same into a solid thermoplastic mass, cooling said solid thermoplastic mass while maintaining the pressure thereon, until said mass reaches room temperature, and removing the thus cooled mass from the die, thus obtaining a solid thermoplastic body capable of withstanding a pressure of 500 kg/cm$^2$.

2. Method according to claim 1 wherein the heating of said particulate leather scrap in the closed die at said pressure is for a time of at least 30 seconds.

3. Method according to claim 1 wherein said particulate leather scrap is subjected to an initial pressure above about 500 bar in the closed die at room temperature prior to subjecting the same to said temperature of 200-900 bar at a temperature of about 50°-250° C.

* * * * *